US006076516A

United States Patent [19]

Tucker

[11] Patent Number: 6,076,516

[45] Date of Patent: Jun. 20, 2000

[54] PORTABLE OVEN AIR CIRCULATING DEVICE

[76] Inventor: Iler D. Tucker, 1658 Parkside Cir., Niceville, Fla. 32578

[21] Appl. No.: 09/276,451

[22] Filed: Mar. 25, 1999

[51] Int. Cl.[7] ..... F24C 15/32

[52] U.S. Cl. ..... 126/21 A; 185/40 F; 417/328; 99/447

[58] Field of Search ..... 126/21 A; 185/40 F; 417/328; 99/447

[56] References Cited

U.S. PATENT DOCUMENTS

| | | |
|---|---|---|
| 879,580 | 2/1908 | Pearsall . |
| 1,362,653 | 12/1920 | Turner . |
| 1,365,455 | 1/1921 | Chapman . |
| 4,357,931 | 11/1982 | Wolpert et al. . |
| 4,438,836 | 3/1984 | Kagata . |
| 4,687,908 | 8/1987 | Thorne . |
| 4,829,158 | 5/1989 | Burnham . |
| 5,148,737 | 9/1992 | Poulson . |
| 5,235,962 | 8/1993 | Doty et al. . |
| 5,657,686 | 8/1997 | Gunawardena et al. . |
| 5,662,029 | 9/1997 | Ubert et al. . |
| 5,738,197 | 4/1998 | Kroger et al. . |
| 5,838,641 | 11/1998 | Tohkoku et al. . |

*Primary Examiner*—Carroll Dority
*Attorney, Agent, or Firm*—Edward A. McConwell

[57] ABSTRACT

A air circulator for an oven includes a housing having inlet and outlet walls with openings in each wall for permitting air to pass through the housing. The air circulator further includes a fan assembly within the housing having a rotatable fan element and a plurality of fan blades attached radially about the fan element for drawing air through the housing upon rotation of the fan element. A spring motor assembly is positioned within the housing and coupled with the fan assembly for rotating the fan element. The air circulator further includes a heat sensitive switch formed of a combination of metals which contracts upon an increase in the ambient air temperature of the oven for activating the spring motor.

20 Claims, 9 Drawing Sheets

PORTABLE OVEN AIR CIRCULATING DEVICE

BACKGROUND OF THE INVENTION

The present invention relates to oven air circulating devices and, more particularly, to a portable oven air circulator which does not require an external power source or manual preparation by a user for operation.

Several devices are known in the art for circulating air within an oven for improving the efficiency and speed of heating food items within the oven. Some such devices are constructed as part of the oven and are powered by electricity. Other oven air circulators, such as those disclosed in U.S. Pat. Nos. 4,561,416, 4,457,292, and 5,337,654, are portable and self-contained, deriving power from a spring motor. The utility of these spring motor devices is limited, however, in that they must be manually wound or coiled prior to each use. Further, the speed with which a circulation fan can be rotated is dependent upon the size of the gears within the gear train.

It is therefore desirable to have a portable oven air circulator having a spring motor that does not require manual winding or electrical power. It is further desirable to have an oven air circulator in which each incremental movement of a gear can impart numerous rotations to a fan.

SUMMARY OF THE INVENTION

An oven air circulator constructed in accordance with the present invention utilizes a housing having opposed inlet and outlet walls with each wall presenting an opening for permitting passage of air through the housing. The oven air circulator also includes a fan assembly comprising a fan having a plurality of fan blades adapted to draw air through the housing upon rotation of the fan. A spring motor is mounted within the housing and coupled with the fan assembly for rotating the fan. A heat sensitive plate winds the spring motor as the oven temperature increases and then releases the motor to unwind, causing the fan to rotate.

It is therefore a general object of this invention to provide an oven air circulator which can force air currents down upon food items in an oven.

Another object of this invention is to provide an oven air circulator, as aforesaid, which is portable for selective use within an oven.

Still another object of this invention is to provide an oven air circulator, as aforesaid, which requires no external power source for operation.

Yet another object of this invention is to provide an oven air circulator, as aforesaid, which requires no manual winding of a spring motor.

A further object of this invention is to provide an oven air circulator, as aforesaid, having a spring motor that is wound according to a rise in oven temperature.

A still further object of this invention is to provide an oven air circulator, as aforesaid, in which each incremental movement of a gear imparts multiple revolutions to a free-wheeling circulation fan.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
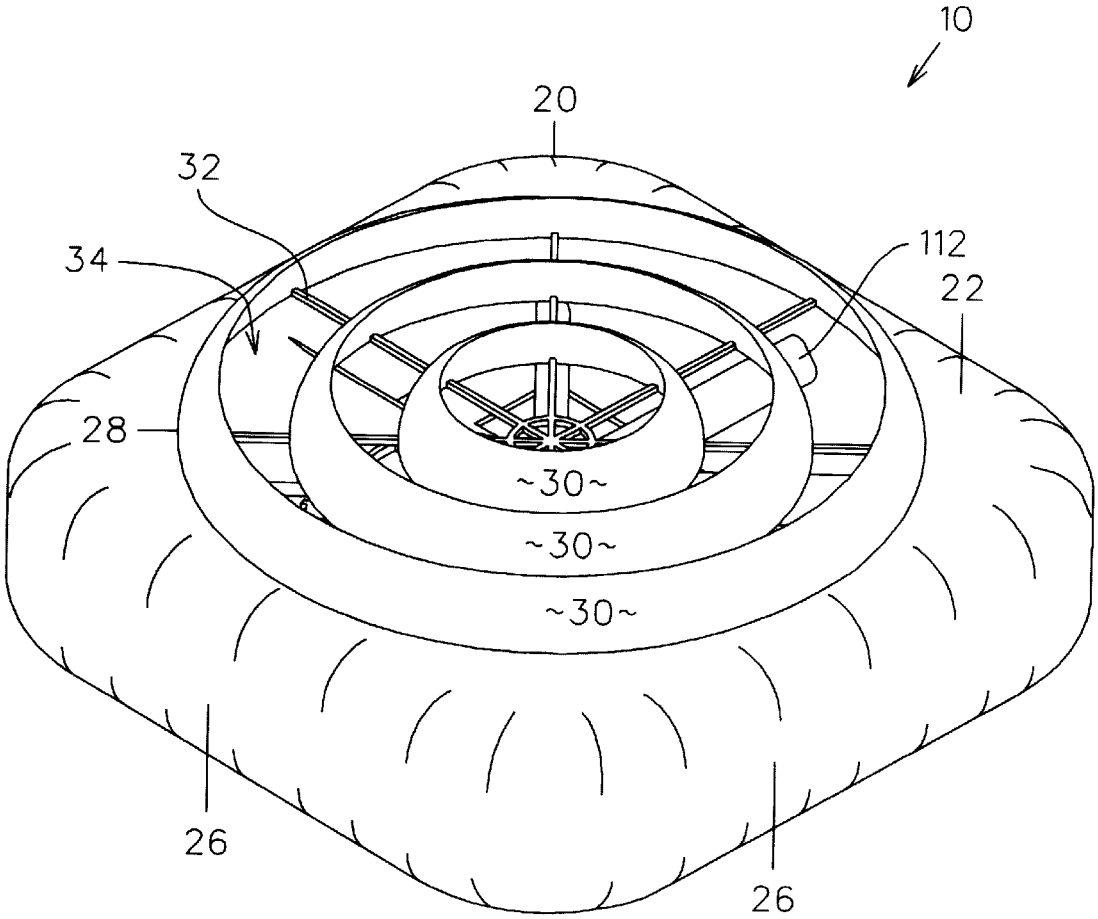
FIG. 1 is a perspective view of the outlet side of the oven air circulator.
Figure 2:
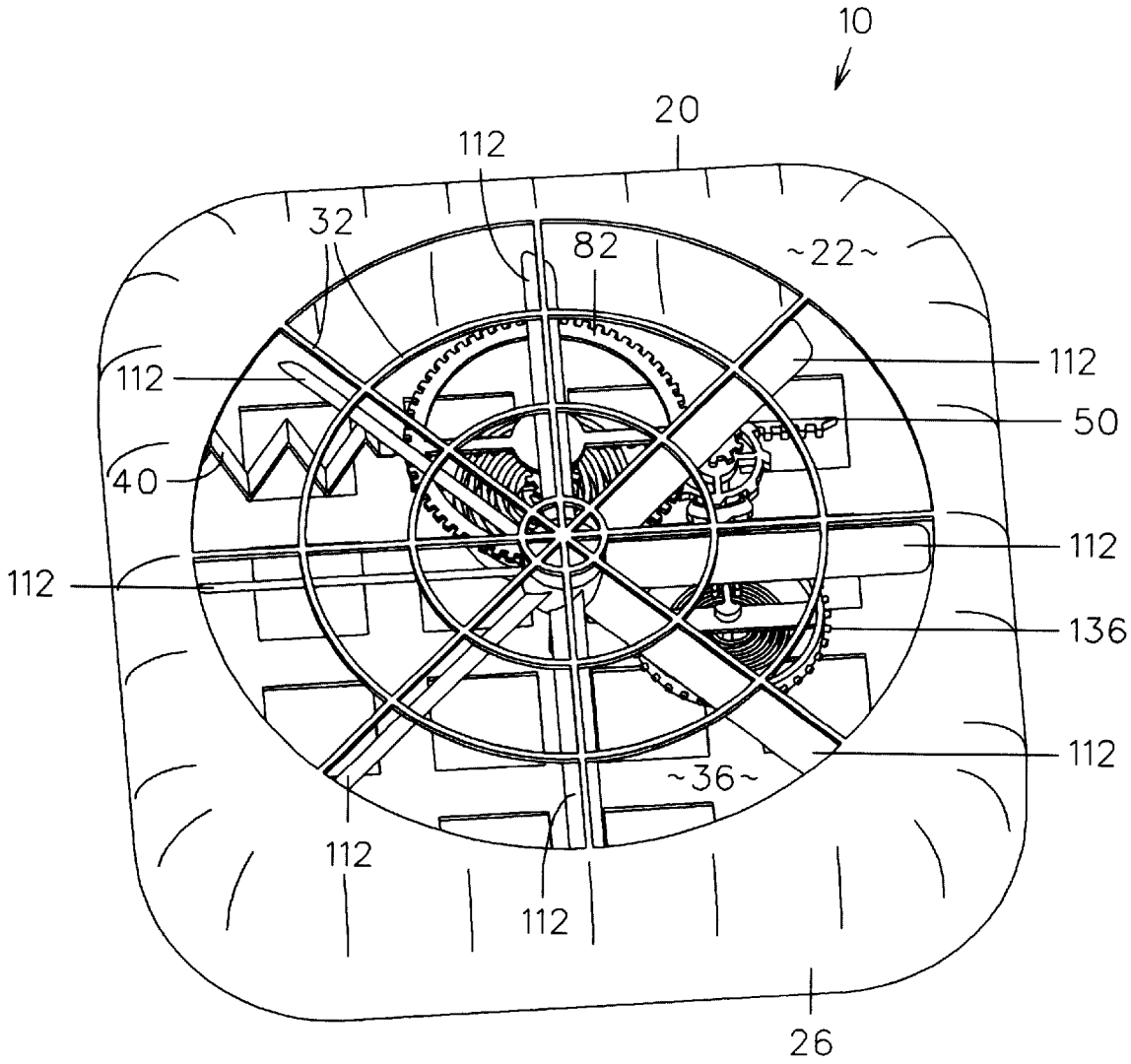
FIG. 2 is a perspective view of the oven air circulator of FIG. 1 with the diffuser removed.
Figure 3:
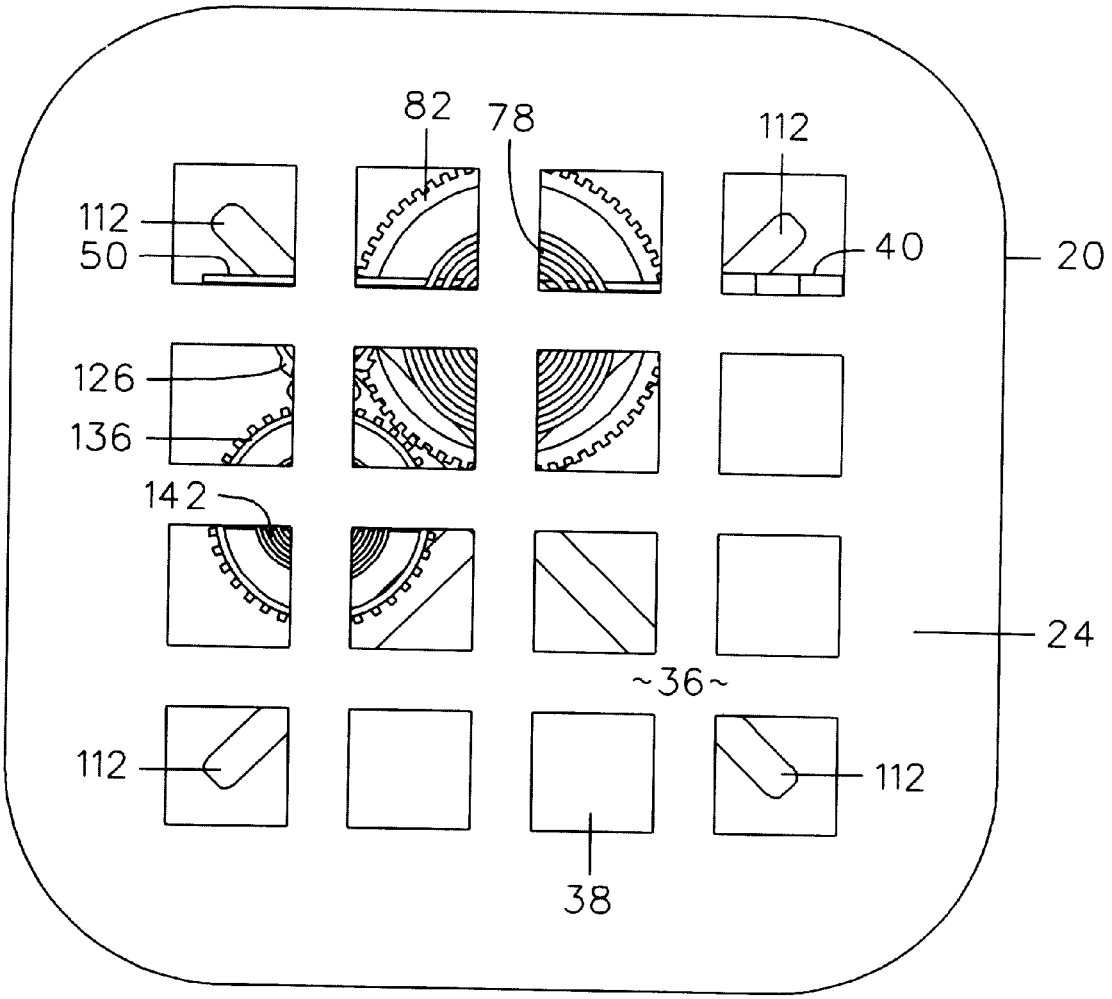
FIG. 3 is an inlet side view of the oven air circulator of FIG. 2.
Figure 4:
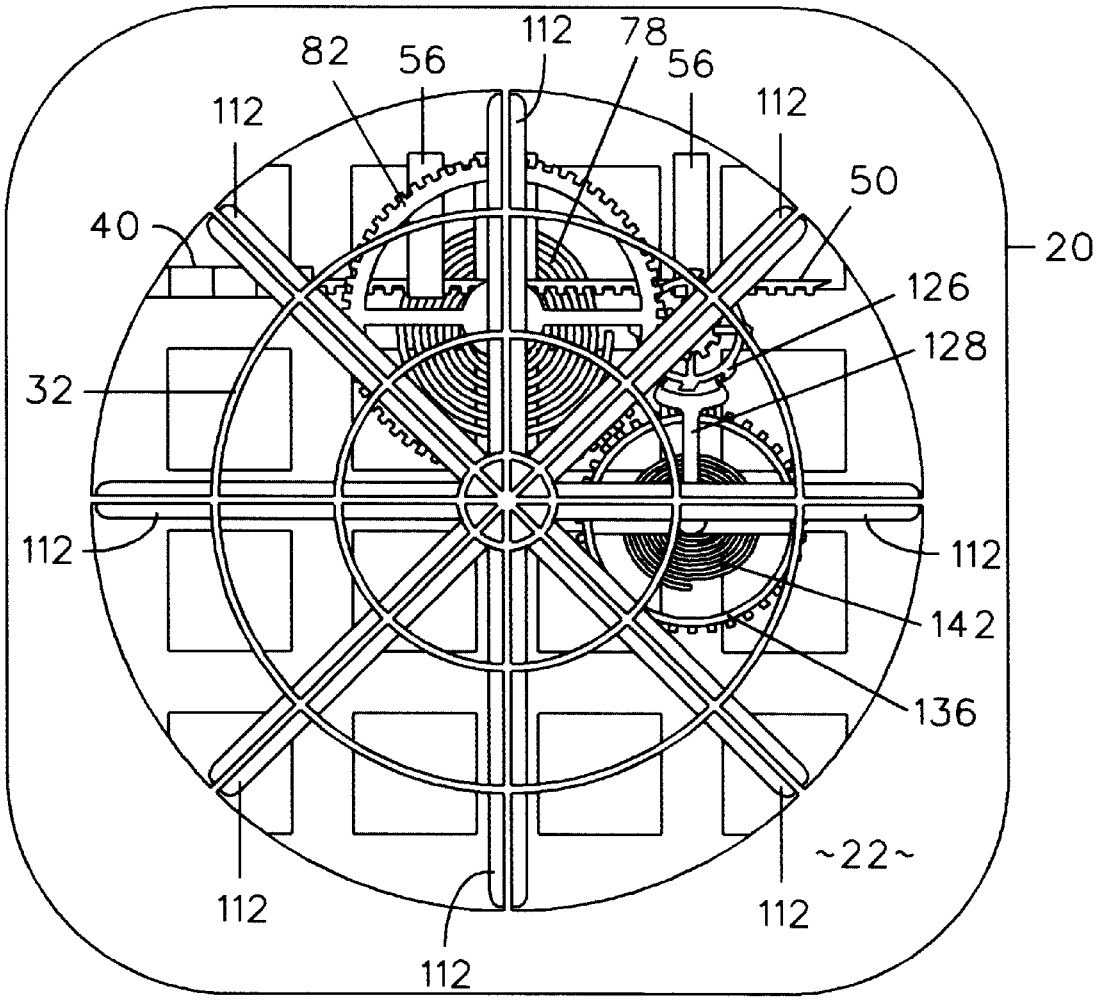
FIG. 4 is an outlet side view of the oven air circulator of FIG. 2.

An oven air circulator 10 in accordance with a preferred embodiment of the present invention includes a housing 20 having generally square outlet 22 and inlet 24 walls with sidewalls 26 intermediate the outlet 22 and inlet 24 walls (FIGS. 1–3). The housing 20 is preferably molded of a heat resistant thermoplastic material. A lightweight sheet metal construction covered with a heat resistant paint may alternatively be used. The inlet wall 24 of the housing 20 includes a grate 36 having a plurality of apertures 38 through which air may be drawn into the housing 20 during operation (FIG. 3). The outlet wall 22 presents a circular opening 34 through which air is forced during operation of the circulator 10, as to be more fully described below. A diffuser 28 having concentric diffusion members 30 extends from the outlet wall 22, each diffusion member 30 being inwardly annular for directing air currents toward a central oven location (FIG. 1). The diffuser 28 is mounted to support members 30 that are integrally attached to the outlet wall 22 (FIGS. 1, 2 and 4). The diffuser 28 and support members 30 span the opening 34 and prevent a user's fingers from inadvertently extending into the housing 20.

Figure 5:
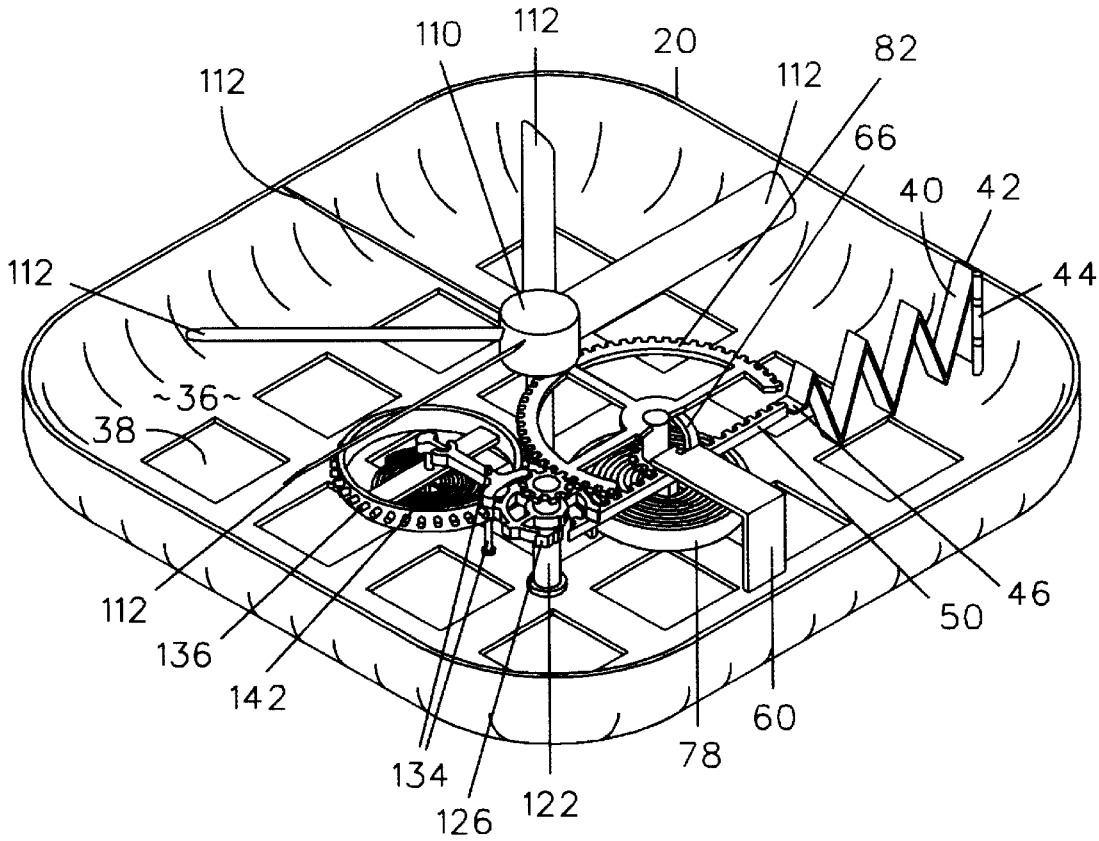
FIG. 5 is a perspective view of the oven air circulator of FIG. 2 with a portion of the housing, fan, and main gear removed.
Figure 8:
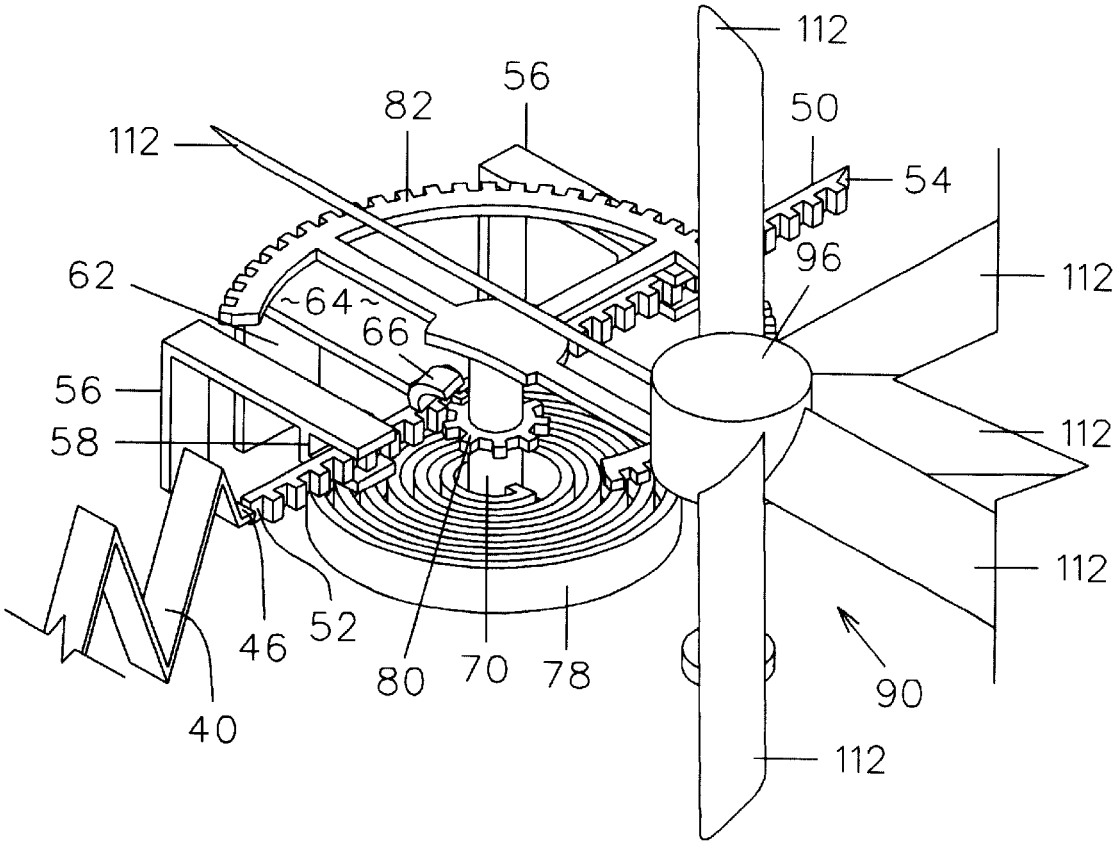
FIG. 8 is a fragmentary view of the circulator on an enlarged scale with the plate and rack in a partially contracted configuration upon a heating of the plate.

The oven air circulator 10 includes an accordion-like plate 40 constructed of a shape memory material such as a nickel-titanium metal alloy. As it is heated, the plate 40 tends to contract between an extended, loosely folded configuration and a generally upright, tightly contracted configuration. One end 42 of the plate 40 is coupled to a spring biased hinge 44, the hinge 44 being pivotally attached to the interior surface of a sidewall 26 of the housing 20. An opposed end 46 of the plate 40 is fixedly attached to a first end 52 of a rack gear 50 that is linearly movable according to the extension or contraction of the plate 40 (FIG. 5). A pair of guide members 56 are fixedly attached to the interior surface of the inlet wall 24, each guide member 56 having a U-shaped end 58 defining a channel for supporting the rack 50 during movement thereof (FIGS. 6 and 8).

An L-shaped bracket 60 is fixedly attached to the interior surface of the inlet wall 24 of the housing 20 (FIG. 5). The bracket 60 includes an upstanding first arm 62 normal to an inwardly extending second arm 64. An annular cover 66 is pivotally coupled to the free end of the second arm 64 with a spring hinge 68 (FIG. 6). Prior to a heating of the oven, the cover 66 is in a vertical configuration normal to the second arm 64 of the bracket 60 and bearing against the end 46 of the plate 40 adjacent the rack 50. As rack 50 bears against the cover 66 upon a heating of the oven, the cover 66 is biased toward the second arm 64 of the bracket 60 and is thus precluded from interfering with the engagement of the rack 50 and pinion 80 (FIG. 8), as to be further described below.

Figure 6:
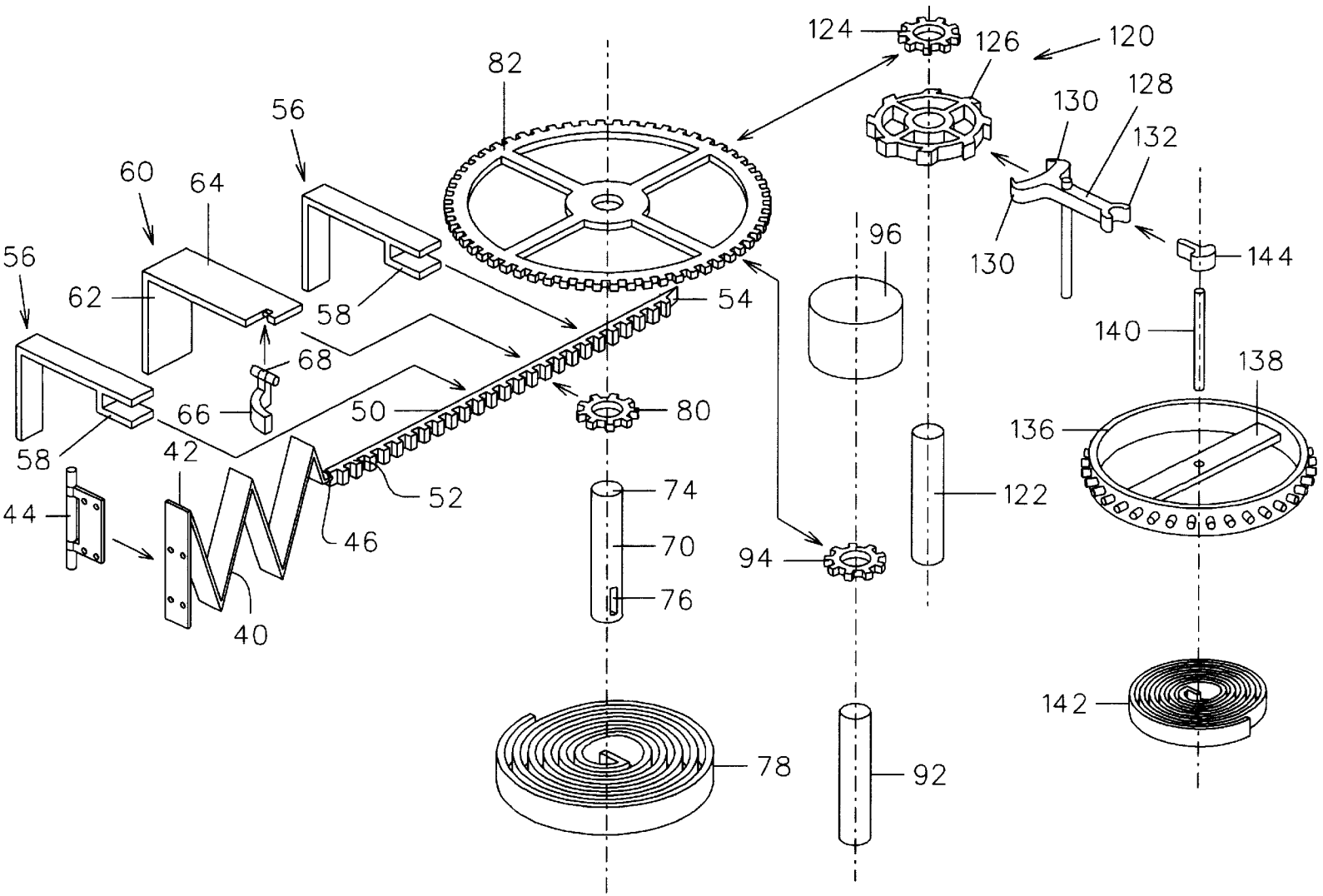
FIG. 6 is an exploded view of the oven air circulator with the housing and fan blades removed.

The circulator 10 further includes a shaft 70 having first 72 and second 74 ends (FIG. 6). The first end 72 defines a slot 76 which couples the shaft 70 to a coil mainspring 78. A pinion gear 80 is attached to the shaft 70 between the first 72 and second 74 ends and includes teeth adapted to engage the teeth of the rack 50. Thus, the mainspring 78 is coiled as the rack 50 engages the pinion 80 upon contraction of the plate 40. A drive wheel 82 is fixedly attached to the second end 74 of the shaft 70 and coaxial with the pinion 80.

Figure 7B:
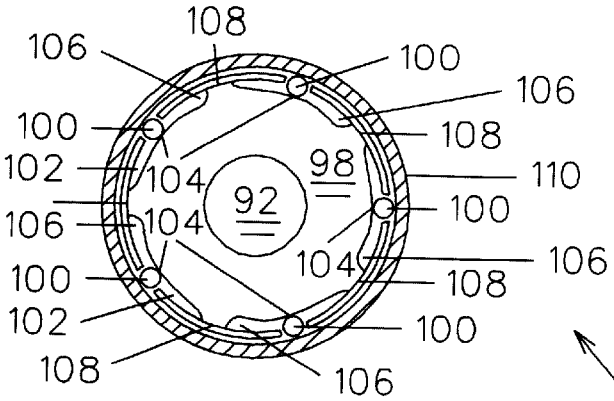
FIG. 7B is a section view of the fan assembly taken along line 7B—7B of FIG. 7A.
Figure 7C:
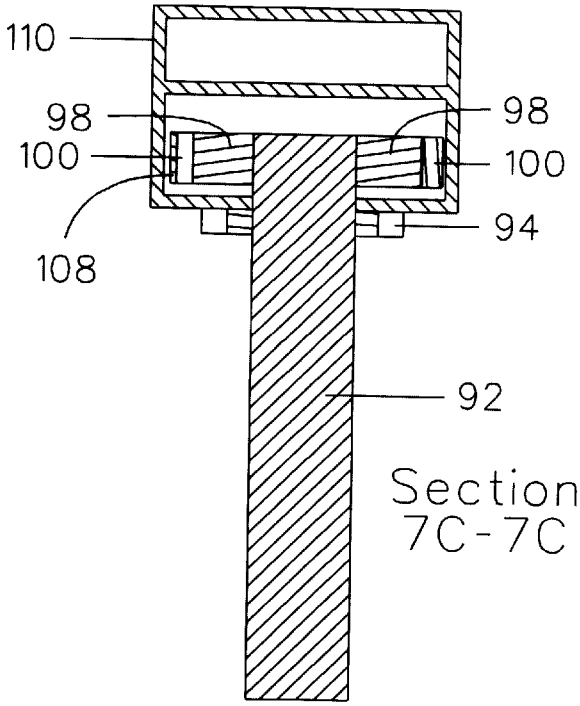
FIG. 7C is a section view of the fan assembly taken along line 7C—7C of FIG. 7A.
Figure 7A:
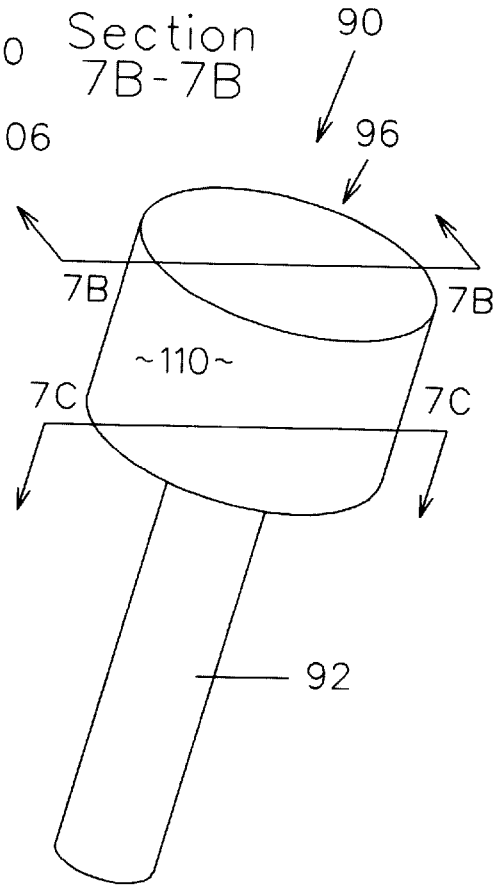
FIG. 7A is a perspective view of the fan assembly.

The circulator 10 further includes a fan assembly 90 having a hub axle 92 rotatably mounted to the inlet grate 36 within the housing 20. A pinion gear 94 is fixedly attached to the hub axle 92 and includes teeth in meshing engagement with the teeth of the drive wheel 82. A freewheeling hub assembly 96, the construction of which is generally known, is coupled to the pinion 94. As more particularly shown in FIG. 7A through 7C, the freewheeling hub assembly 96 includes a ratchet 98 fixedly attached to the hub axle 92, the ratchet 98 having roller bearings 100 slidably disposed within tapered slot housings 102. The hub assembly 96 includes roller guide rings 108 for holding the bearings 100 within the slot housings 102. As the hub axle 92 is rotated by the fan assembly pinion gear 94, the bearings 100 are urged by the tapered edges 104 of the slot housings 102 to bear against an outer cylindrical hub 110 that is rotatably coupled to the hub axle 92. Thus, rotational torque is transmitted to the hub 110. When the hub axle 92 ceases to rotate, the bearings 100 drop into the recesses 106 of the slot housings 102. The hub 110, however, continues to rotate freely. A plurality of radially spaced apart fan blades 112 are fixedly attached to the side wall of the hub 110. The fan blades 112 may be weighted to maintain the velocity of the hub 110 during freewheeling rotation. The fan blades 112 are designed such that upon rotation air is drawn into the housing through the inlet apertures 38 and expelled through the outlet opening 34.

The circulator 10 further includes an escapement assembly 120 for regulating the speed at which the drive wheel 82 rotates the fan assembly 90 (FIG. 6). Escapement assemblies are known in the art, especially for timing the movement of gears in analog timepieces. The escapement assembly 120 includes a shaft 122 rotatably coupled to the grate 36. A pinion gear 124 is fixedly attached at one end of the shaft 122 and includes teeth in meshing engagement with the teeth of the drive wheel 82. An escape wheel 126 is coaxially mounted to the shaft 122. The rotational force of the drive wheel 82 is transmitted to the escape wheel 126 as the pinion 124 and shaft 122 are rotated.

The escapement assembly 120 further includes a balance wheel 136 having a bridge 138 spanning its diameter. A rod 140 extends through the bridge 138 and is coupled at one end to a hairspring 142. A flange 144 is fixedly attached to an opposed end of the rod 140. The escapement assembly 120 includes a lever 128 pivotally attached to a rod 134. One end of the lever 128 presents a pair of spaced apart pallets 130 which engage the teeth of the escape wheel 126. The lever 128 also includes a generally U-shaped end 132 which mates with flange 144. The rotational force of the escape wheel 126 is transmitted through the lever 128 to the balance wheel 136. The rotational force of the escape wheel 126 pivots the lever 128 in a first direction, causing the U-shaped end 132 to bear against the flange 144 and bias the hairspring 142. The hairspring 142 then snaps back to its normal unbiased configuration, causing the flange 144 to reverse the pivot of the lever 128. As the lever 128 is pivoted in this opposed direction, the pallets 130 release the escape wheel 126 for an interval of time, allowing the escape wheel 126, pinion 124, and drive wheel 82 to rotate by one tooth and thus rotate the fan assembly 90. It should be appreciated that the rotational force of the escape wheel 126 maintains the continuous oscillation of the balance wheel 136. Further, the tension of the hairspring 142 determines the ultimate speed of the drive wheel 82.

In operation, the oven air circulator 10 is preferably positioned on the upper rack of an oven such that the outlet wall 22 rests against the rack. Thus, oven air is pulled through the inlet grate 36 and forced down upon food items on the lower oven rack by the fan blades 112. As the oven is preheated, or whenever the circulator 10 is placed within the oven, the shape memory metal plate 40 begins to contract, in turn operating the rack 50 and pinion 80 to coil the mainspring 78.

As the plate 40 contracts, the rack 50 is pulled in the direction of the contracting plate 40. As the first end 52 of the rack 50 bears against the cover 66, the cover 66 is rotated to a biased configuration and bears against the top surface of the rack 50 (FIG. 8). The cover 66 remains in this biased configuration until the plate 40 is fully contracted and the free end 54 of the rack 50 has passed by the cover 66, allowing the cover 66 to return to its vertical configuration. With the plate 40 and rack 50 fully contracted, the cover 66 is configured so as to shield the pinion 80 and thus prevent the rack 50 from engaging the pinion 80 in an opposite direction. This configuration also allows the mainspring 78 to begin unwinding.

As the mainspring 78 uncoils, the drive wheel 82 is rotated to operate the fan assembly 90. The drive wheel 82 engages the fan assembly pinion gear 94 which turns the hub axle 92 and ratchet 98. Rotation of the ratchet 98 forces the roller bearings 100 into contact with the outer hub 110 according to the tapered edges 104 of the slot housings 102. The hub 110 is then allowed to rotate freely as the bearings 100 drop back into the recesses 106 of the slot housings 102. The hub 110 is repeatedly powered in this manner upon each movement of the escape wheel 126 as described above.

Figure 9:
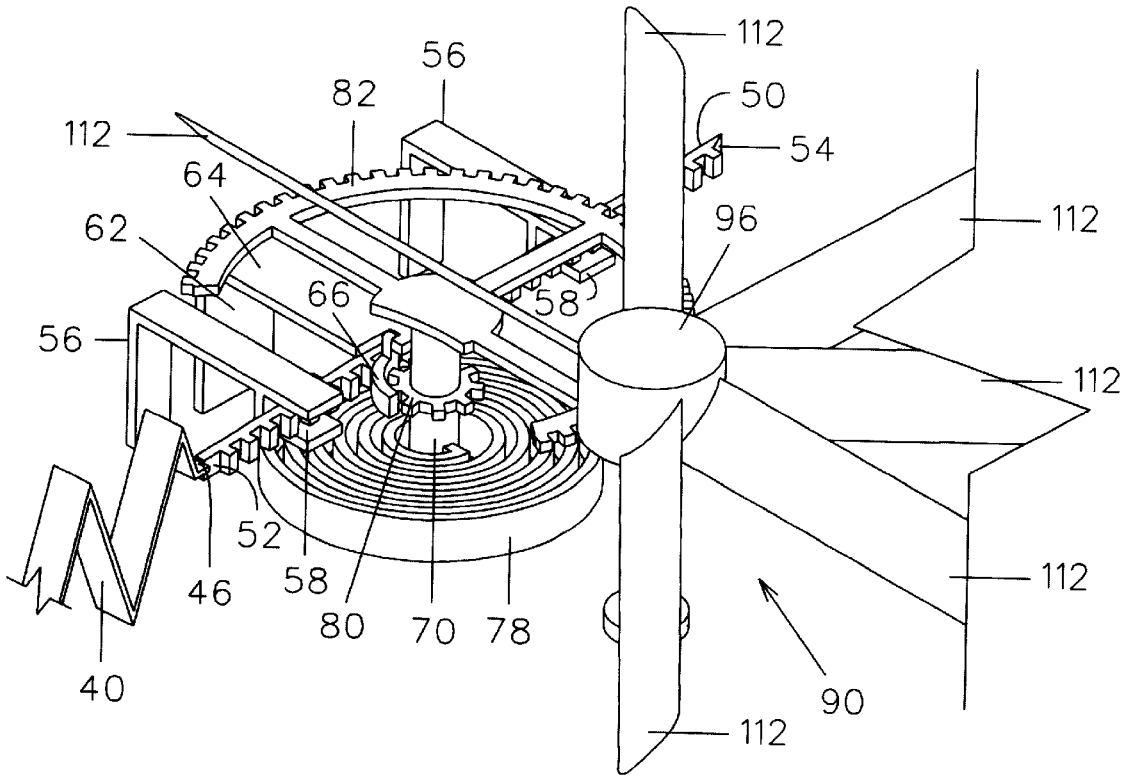
FIG. 9 is a fragmentary view of the circulator on an enlarged scale with the plate and rack in a partially extended configuration upon a cooling of the plate.

As the plate 40 cools following use, the rack 50 is displaced from the pinion 80 as the free end 54 of the rack 50 bears against the cover 66 (FIG. 9). The hinge 44 allows the plate 40 and rack 50 to be shifted away from the pinion 80 without bending these elements. When the entire rack 50 has slidably moved past the cover 66 as the plate 40 is extended to a partially folded configuration, the cover 66 returns to its initial configuration against the end 46 of the plate 40 adjacent the rack 50. The circulator 10 is then ready to be used again.

Accordingly, the oven air circulator 10 can circulate air within an oven for improving the efficiency and speed of heating food items. The oven air circulator 10 can circulate air without requiring an electrical power source or manual winding of a spring.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An air circulator for an oven, comprising:

a housing including inlet and outlet walls, each wall presenting an opening for permitting passage of air through the housing;

a fan assembly positioned within the housing including a rotatable fan element having a plurality of blades for drawing air through the housing upon rotation of the fan element;

a spring motor assembly positioned within the housing and coupled with the fan assembly for rotating the fan element; and a heat sensitive switch for activation of the motor assembly.

2. An air circulator as in claim 1 wherein the switch includes one end attached to the housing and an another end coupled to the motor assembly, the switch contracting and expanding according to a change in the ambient air temperature, a contraction of the switch causing the motor to be activated.

3. An air circulator as in claim 2 wherein the switch comprises a combination of metals contracting or expanding in response to increases or decreases in ambient air temperature.

4. An air circulator as in claim 2 wherein the spring motor assembly includes:

a spring coupled to the switch such that the spring is coiled upon a contraction of the switch and the spring is permitted to uncoil when the switch is fully contracted; and gearing means for transmitting rotation from the spring to the fan element upon an uncoiling of the spring.

5. An air circulator as in claim 1 wherein the fan assembly includes:

a rotatable hub axle;

a rotatable wheel hub; and freewheel means for transmitting rotation from the axle to the wheel hub and for permitting rotation of the wheel hub when the axle is not rotating.

6. An air circulator as in claim 1 further comprising:

gearing means coupled to the spring motor assembly;

a rotatable escape wheel positioned within the housing and coupled to the gearing means, the gearing means transmitting rotation from the spring motor assembly to the escape wheel;

a balance wheel positioned within the housing and including a means for oscillating; and a lever for transmitting rotation from the escape wheel to the balance wheel and causing the balance wheel to oscillate, the escape wheel and gearing means rotating between oscillations of the balance wheel, whereby rotation of the gearing means is transmitted to the fan assembly according to the frequency of oscillation.

7. The air circulator as in claim 1 wherein the switch is formed of two types of metal, the switch contracting and expanding in response to changes in ambient air temperature.

8. An air circulator for an oven, comprising:

a housing including inlet and outlet walls, each wall presenting an opening for permitting passage of air through the housing;

a fan assembly positioned within the housing including a rotatable fan element having a plurality of blades for drawing air through the housing upon rotation of the fan element, said fan assembly further comprising:

a rotatable hub axle;

a rotatable wheel hub; and freewheel means for transmitting rotation from the axle to the wheel hub and for permitting rotation of the wheel hub when the axle is not rotating; and a spring motor positioned within the housing and including a gear train coupled with the hub axle for rotating the fan element; and means for energizing the spring motor.

9. An air circulator as in claim 8 wherein the freewheel means includes:

a ratchet attached to the axle and presenting a plurality of peripheral slot housings; and a plurality of bearings positioned within the slot housings and slidable therein upon rotation of the ratchet, the bearings moving to a position bearing against the wheel hub upon a rotation of the axle for transmitting rotation from the axle to the wheel hub and permitting rotation of the wheel hub when the axle is not rotating.

10. The air circulator as in claim 8 wherein the energizing means includes a heat sensitive switch having an end attached to the housing and an another end coupled to the motor assembly, the switch contracting and expanding according to a change in the ambient air temperature, a contraction of the switch causing the motor to be activated.

11. An air circulator as in claim 10, wherein the switch comprises a combination of metals contracting or expanding in response to increases or decreases in ambient air temperature.

12. An air circulator as in claim 10, wherein the spring motor includes a spring coupled to the switch such that the spring is coiled upon a contraction of the switch and the spring is permitted to uncoil when the switch is fully contracted, the gear train transmitting rotation from the spring to the fan element upon an uncoiling of the spring.

13. An air circulator as in claim 8 further comprising:

a rotatable escape wheel positioned within the housing and coupled with the gear train, the gear train transmitting rotation from the spring motor assembly to the escape wheel;

a balance wheel positioned within the housing and including a means for oscillating; and a lever having a first end releasably coupled to the escape wheel and a second end coupled to the balance wheel, a rotation of the escape wheel causing the balance wheel to oscillate, the escape wheel and gear train rotate between oscillations of the balance wheel, whereby rotation of the gear train is transmitted to the fan assembly according to the frequency of oscillation.

14. An air circulator for an oven, comprising:

a housing including inlet and outlet walls, each wall presenting an opening for permitting passage of air through the housing;

a fan assembly positioned within the housing including a rotatable fan element having a plurality of blades for drawing air through the housing upon rotation of the fan element;

a spring motor positioned within the housing including a gear train and coupled to the fan assembly for rotating the fan element;

means for energizing the spring motor;

a rotatable escape wheel positioned within the housing and coupled to the gear train, the gear train transmitting rotation from the spring motor to the escape wheel;

a balance wheel positioned within the housing including a means for oscillating; and a lever having a first end releasably coupled to the escape wheel and a second end coupled to the balance wheel, a rotation of the escape wheel causing the balance wheel to oscillate, the escape wheel and gear train rotating between oscillations of the balance wheel, whereby rotation of the gear train is transmitted to the fan assembly according to the frequency of oscillation.

15. An air circulator as in claim 14 wherein the oscillating means includes:

a hairspring; and a rod having one end coupled to the hairspring and another end coupled to the balance wheel and the second end of the lever, a movement of the lever causing a momentary bias of the hairspring, a return of the hairspring to an unbiased configuration causing a movement of the lever in an opposed direction for permitting the escape wheel and gear train to rotate.

16. The air circulator as in claim 14 wherein the energizing means includes a heat sensitive switch having an end attached to the housing and another end coupled to the motor assembly, the switch contracting and expanding according to a change in the ambient air temperature, a contraction of the switch causing the motor to be activated.

17. An air circulator as in claim 16, wherein the switch comprises a combination of metals contracting or expanding in response to increases or decreases in ambient air temperature.

18. An air circulator as in claim 14 wherein the fan assembly includes:

a rotatable hub axle;

a rotatable wheel hub; and freewheel means for transmitting rotation from the axle to the wheel hub and for permitting rotation of the wheel hub when the axle is not rotating.

19. An air circulator as in claim 18 wherein the freewheel means includes:

a ratchet attached to the axle and presenting a plurality of peripheral slot housings; and a plurality of bearings positioned within the slot housings and slidable therein upon rotation of the ratchet, the bearings moving to a position bearing against the wheel hub upon a rotation of the axle for transmitting rotation from the axle to the wheel hub and permitting rotation of the wheel hub when the axle is not rotating.

20. An air circulator as in claim 18 wherein the plurality of blades are coupled to the wheel hub and are configured to draw air through the housing upon rotation of the wheel hub.

* * * * *